US006770000B2

(12) United States Patent
Shelley

(10) Patent No.: US 6,770,000 B2
(45) Date of Patent: Aug. 3, 2004

(54) APPARATUS AND METHOD FOR A GOLF ALIGNMENT PADDLE

(76) Inventor: Ben Shelley, 1530 Highland Ave. NW., Cleveland, TN (US) 37311

( * ) Notice: Subject to any disclaimer, the term of this patent is extended or adjusted under 35 U.S.C. 154(b) by 46 days.

(21) Appl. No.: 10/117,811

(22) Filed: Apr. 8, 2002

(65) Prior Publication Data

US 2003/0190980 A1 Oct. 9, 2003

(51) Int. Cl.[7] ..... A63B 57/00
(52) U.S. Cl. ..... 473/404; 33/277
(58) Field of Search ..... 473/404, 407, 473/409, 268; 33/286, 289, 276, 277, 281, 282, 284, 285, 292

(56) References Cited

U.S. PATENT DOCUMENTS

| | | | | |
|---|---|---|---|---|
| 1,536,512 A | | 5/1925 | McLaren | |
| 1,583,965 A | * | 5/1926 | Dunn | 33/277 |
| 2,463,798 A | | 3/1949 | Paisley | |
| 2,519,727 A | * | 8/1950 | Yezdan | 33/277 |
| 2,670,209 A | | 2/1954 | Fay | |
| 2,898,109 A | | 8/1959 | Williams | |
| 3,170,698 A | | 2/1965 | Schoeffler et al. | |
| 3,293,755 A | * | 12/1966 | Cronwell | 473/404 |
| 3,507,500 A | | 4/1970 | Scott | |
| 3,810,633 A | | 5/1974 | Scott, III | |
| 4,174,838 A | | 11/1979 | Paschetto | |
| 4,260,151 A | * | 4/1981 | Weaver | 473/404 |
| 4,340,229 A | | 7/1982 | Stuff, Jr. | |
| 4,984,791 A | * | 1/1991 | Labell | 473/404 |
| 4,988,107 A | | 1/1991 | Sasse | |
| 5,326,096 A | * | 7/1994 | H'Doubler | 473/404 |
| 5,351,961 A | | 10/1994 | Eulau | |
| 5,441,273 A | | 8/1995 | Stormon | |
| 5,503,393 A | * | 4/1996 | Casperson | 473/404 |

* cited by examiner

*Primary Examiner*—Steven Wong
(74) *Attorney, Agent, or Firm*—Michael I. Kroll

(57) ABSTRACT

The present invention 10 discloses an alignment paddle that allows the golfer 18 to identify a straight line between the golf ball 12 and the intended target 14. The hand held alignment paddle includes a vertical elongated aperture 26 and two parallel horizontal apertures 22, 24. One horizontal aperture intersects at the top 22 of the vertical aperture and the other horizontal aperture intersects at the bottom 24 of the vertical aperture 26. The intersections create an upper 34 and a lower 36 viewing passage centerline. The golfer 18 identifies a straight path from the golf ball to the intended target by positioning the paddle in his line of sight such that the golf ball 12 is visible in the lower viewing passage centerline and the intended target, e.g., the hole 14 is in the upper viewing passage centerline. When both the ball 12 and the intended target; e.g., the hole 14 are visible, a straight path has been identified. In the event of a slope in the elevation of the green 10, the golf ball 12 will break to the down side of the slope and the intended target will be to the top side of the slope. Positioning the intended target in the upper viewing passage centerline 34, the hole 14 in the green 16 will be visible to the left of centerline of a left-hand break or to the right of the centerline on a right-and break.

7 Claims, 10 Drawing Sheets

APPARATUS AND METHOD FOR A GOLF ALIGNMENT PADDLE

BACKGROUND OF THE INVENTION

1. Field of the Invention

The present invention relates generally to golf and, more specifically, to a golf assistance device. The present invention is an alignment paddle that allows the golfer to identify a straight line between the golf ball and the intended target. The hand held alignment paddle includes a vertical elongated aperture and 2 parallel horizontal apertures. One horizontal aperture intersects at the top of the vertical aperture and the other horizontal aperture at the bottom of the vertical aperture. The intersections create an upper and a lower viewing passage centerline. The golfer identifies a straight path from the golf ball to the intended target by positioning the paddle in his line of sight such that the golf ball is visible in the lower viewing passage centerline and the intended target is in the upper viewing passage centerline. When both the ball and the intended target are visible, a straight path has been identified.

Viewing through the vertical aperture the golfer can then identify distinct characteristics or objects in the landscape on the straight path. These distinct characteristics or objects are used to maintain the defined straight path to the intended target when the golfer takes their stance to hit the golf ball.

In addition, the horizontal apertures allow for viewing objects adjacent to the intended target. This is desired when the hole in the green is not the intended target. In the event of a slope in the elevation of the green, the golf ball will break to the down side of the slope. The intended target will be to the top side of the slope. Positioning the intended target in the upper viewing passage centerline, the hole in green will be visible to the left of centerline of a left hand break, or to the right of the centerline on a right-hand break.

2. Description of the Prior Art

There are other golf assistance devices designed for aligning a golf shot. There are other golf assistance devices which provide for distance calculations to intended target. While these golf assistance devices may be suitable for the purposes for which they where designed, they would not be as suitable for the purposes of the present invention as heretofore described. It is thus desirable to provide a visible straight line to the intended target while blocking the adjacent landscape from sight line. It is further desirable keep the hole in the green visible in the horizontal aperture when it is not the intended target.

SUMMARY OF THE PRESENT INVENTION

The present invention discloses an alignment paddle that allows the golfer to identify a straight line between the golf ball and the intended target. The hand held alignment paddle includes a vertical elongated aperture and two parallel horizontal apertures. One horizontal aperture intersects at the top of the vertical aperture and the other horizontal aperture intersects at the bottom of the vertical aperture. The intersections create an upper and a lower viewing centerline. The golfer identifies a straight path from the golf ball to the intended target by positioning the paddle in his line of sight such that the golf ball is visible in the lower viewing passage centerline and the intended target, e.g., the hole, is in the upper viewing passage centerline. When both the ball and the intended target; e.g., the holes are visible, a straight path has been identified. Viewing through the vertical aperture the golfer can then identify distinct characteristics or objects in the landscape on the straight path. These distinct characteristics or objects in the landscape on the straight path. These distinct characteristics or objects are used to maintain the defined straight path to the intended target when the golfer takes their stance to hit the ball. In addition, the horizontal apertures allow for viewing objects adjacent to the intended target. This is desired when the hole in the green is not the intended target. In the event of a slope in the elevation of the green, the golf balls will break to the down side of the slope. The intended target will be to the top side of the slope. Positioning the intended target in the upper viewing passage centerline, the hole in the green will be visible to the left of centerline of a left-hand break or to the right of the centerline on a right-and break.

A primary object of the present invention is to provide a straight path from the golf ball to the intended target.

Another object of the present invention is to provide visibility to the intended target.

Yet another object of the present invention is to provide visibility to select objects in the horizontal aperture in the event of a slope in the elevation and break in the flight and/or roll is anticipated.

Still yet another object of the present invention is to provide visibility to distinct characteristics or objects in the landscape on the straight path.

Yet another object of the present invention is to provide training for less experience golfers.

Additional objects of the present invention will appear as the description proceeds.

The present invention overcomes the shortcomings of the prior art by providing isolated visibility to the intended target. In prior method of aligning a golf approach on the green, the golf club is held in a plumb position in line of sight to the intended target. This creates a void in the sight line of the path of the intended target.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
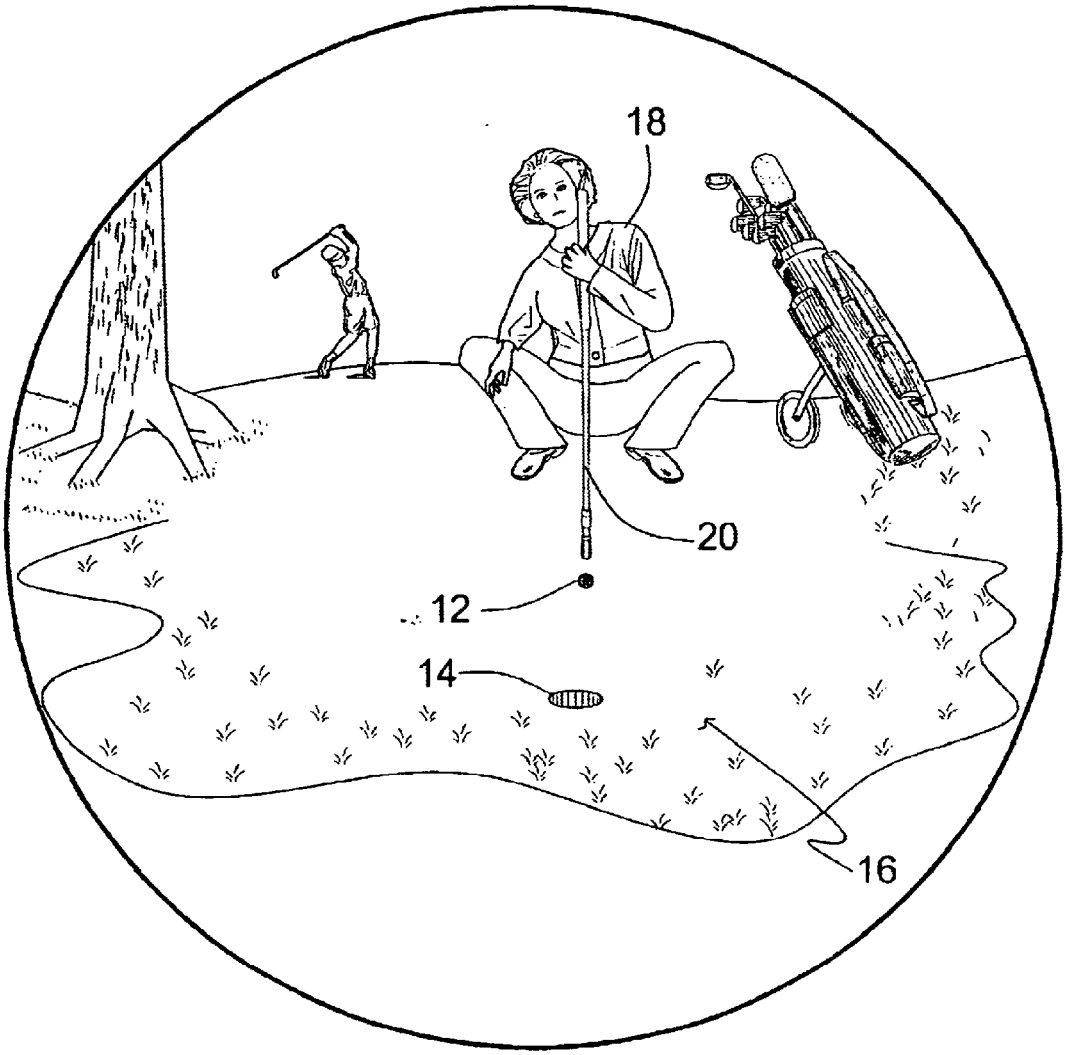
FIG. 1 PRIOR ART
FIG. 1 is an illustrative view of the prior art method of aligning a putt.

With regard to reference numerals used, the following numbering is used throughout the drawings.

10 present invention
12 golf ball
14 hole
16 green
18 golfer
20 golf club
22 upper horizontal aperture
24 lower horizontal aperture
26 vertical aperture
28 golf bag
30 base
32 handle
34 upper centerline
36 lower centerline
38 flare
40 holes

DETAILED DESCRIPTION OF THE PREFERRED EMBODIMENT

The following discussion describes in detail one embodiment of the invention. This discussion should not be construed, however, as limiting the invention to those particular embodiments, since practitioners skilled in the art will recognize numerous other embodiments as well. For a definition of the complete scope of the invention, the reader is directed to the appended claims.

Turning to FIG. 1, shown therein is an illustrative view of the prior art method of aligning a putt. FIG. 1 is a typical method of aligning the golf ball 12 with the hole 14 on a green 16 of a golf course. The golfer 18 holds the handle end of the golf club 20 and allows the opposite end of the club to hang freely toward the ground. The golf club 20 creates a plumb line that is used to identify a straight path toward the hole. Unfortunately this method used to identify a straight path is hindered by the golfer's 18 inability to see directly to the hole 14. Due to the club handles interference with the sight line, the golfer 18 is required to move around the club handle to gain clear sight of the hole 14.

Figure 2:
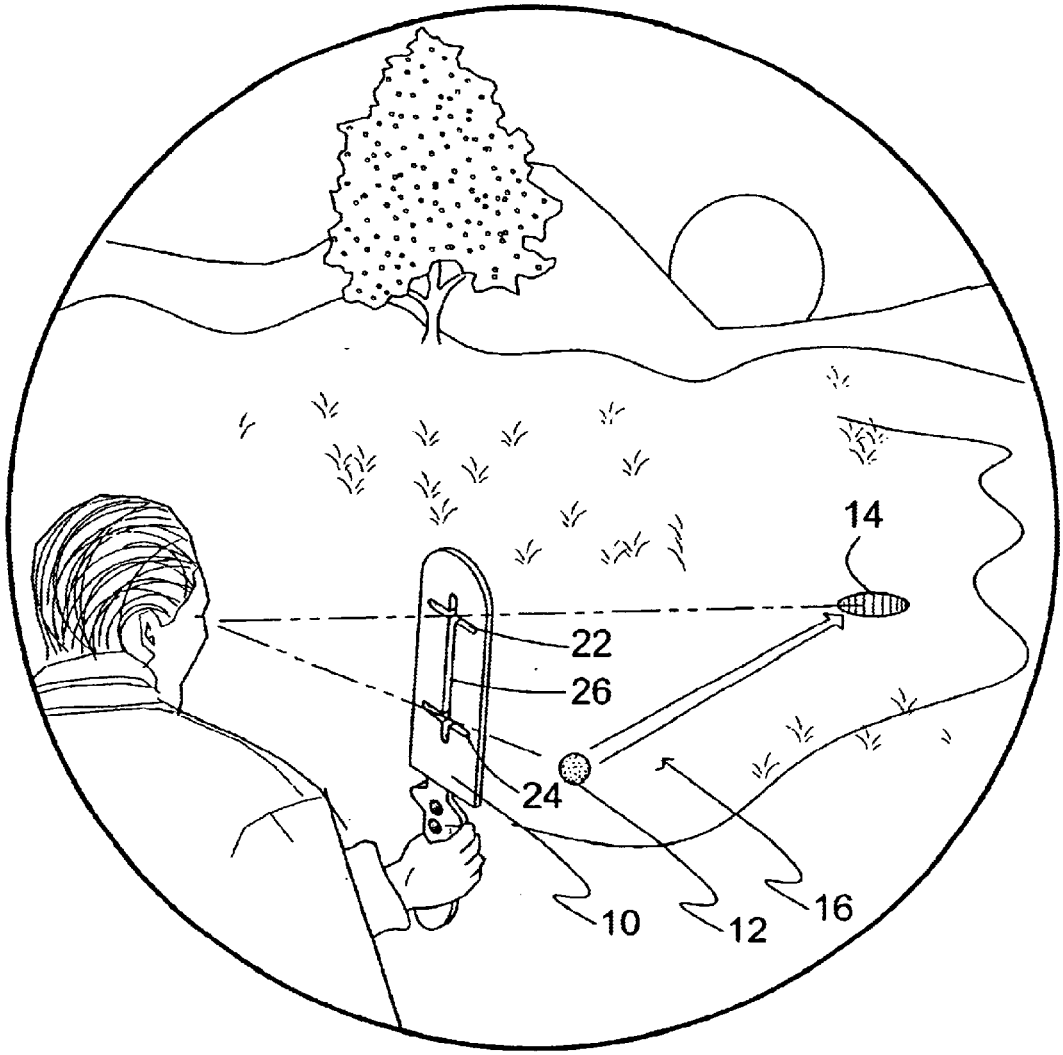
FIG. 2 is an illustrative view of the present invention aligning a putt.

Turning to FIG. 2, shown therein is an illustrative view of the present invention 10 aligning a putt. FIG. 2 exhibits an alignment paddle 10 aligning the golf ball 12 with the hole 14 on a green 16 of a golf course. The present invention 10 has an upper 22 and lower 24 horizontal aperture and an elongated vertical aperture 26. To align the golf ball 12 with the hole 14, position the alignment paddle 10 such that the golf ball 12 is visible in the lower horizontal centering line slot 24 and the hole 14 in the green is visible in the upper horizontal centering line slot 22. Once both 12, 14 are visible, a straight path from the ball 12 to the hole 14 on the green 16 is defined.

Figure 3:
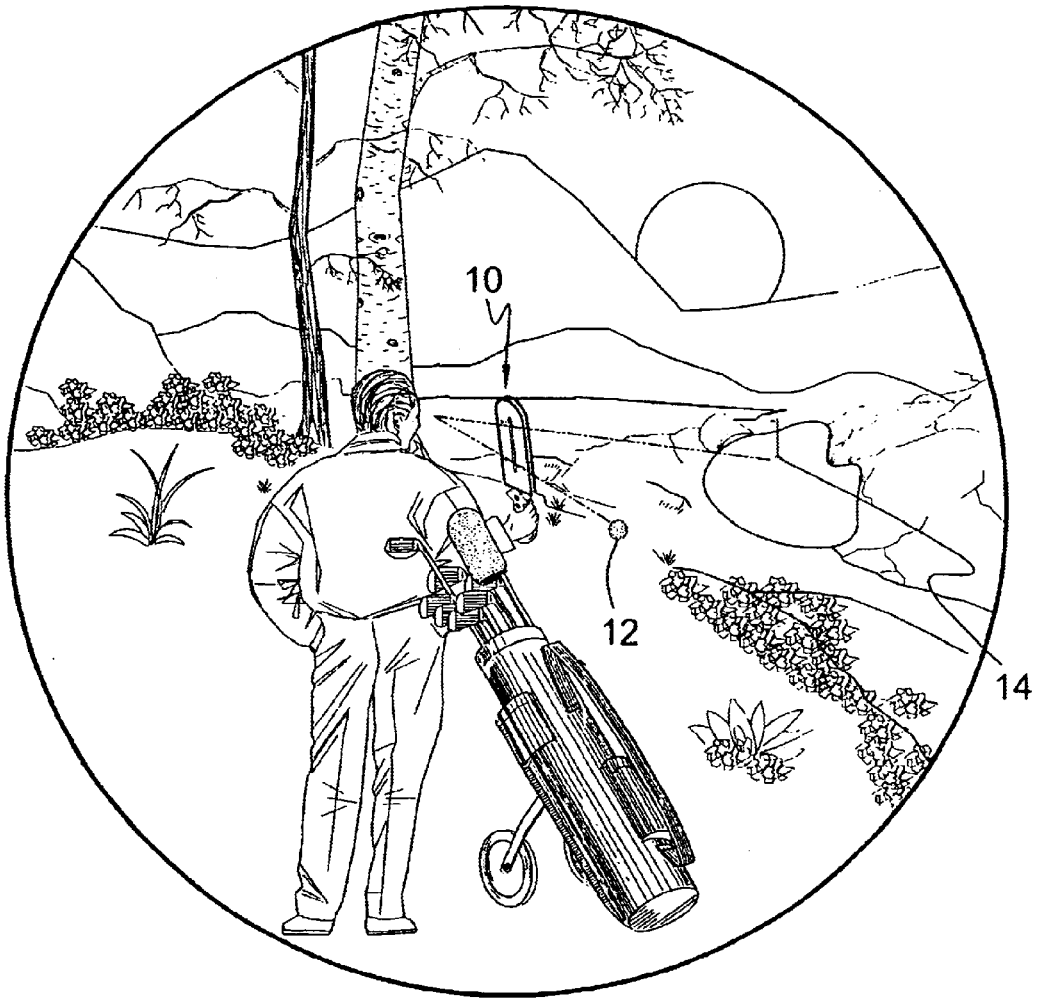
FIG. 3 is an illustrative view of the present invention aligning a fairway approach shot.

Turning to FIG. 3, shown therein is an illustrative view of the present invention 10 aligning a fairway approach shot. FIG. 3 exhibits an alignment paddle 10 aligning a golf ball 12 with the hole 14 in the fairway. The alignment paddle 10 can be used for proper straight alignment on any golf shot. For alignment of a shot of greater distance, back away from the ball 12 and position the alignment paddle 10 such that the golf ball 12 is visible in the lower horizontal centering line slot 24 and the hole 14 in the green is visible in the upper horizontal centering line slot 22. Once both are visible, a straight path from the ball 12 to the hole 14 on the green is defined.

Figure 4:
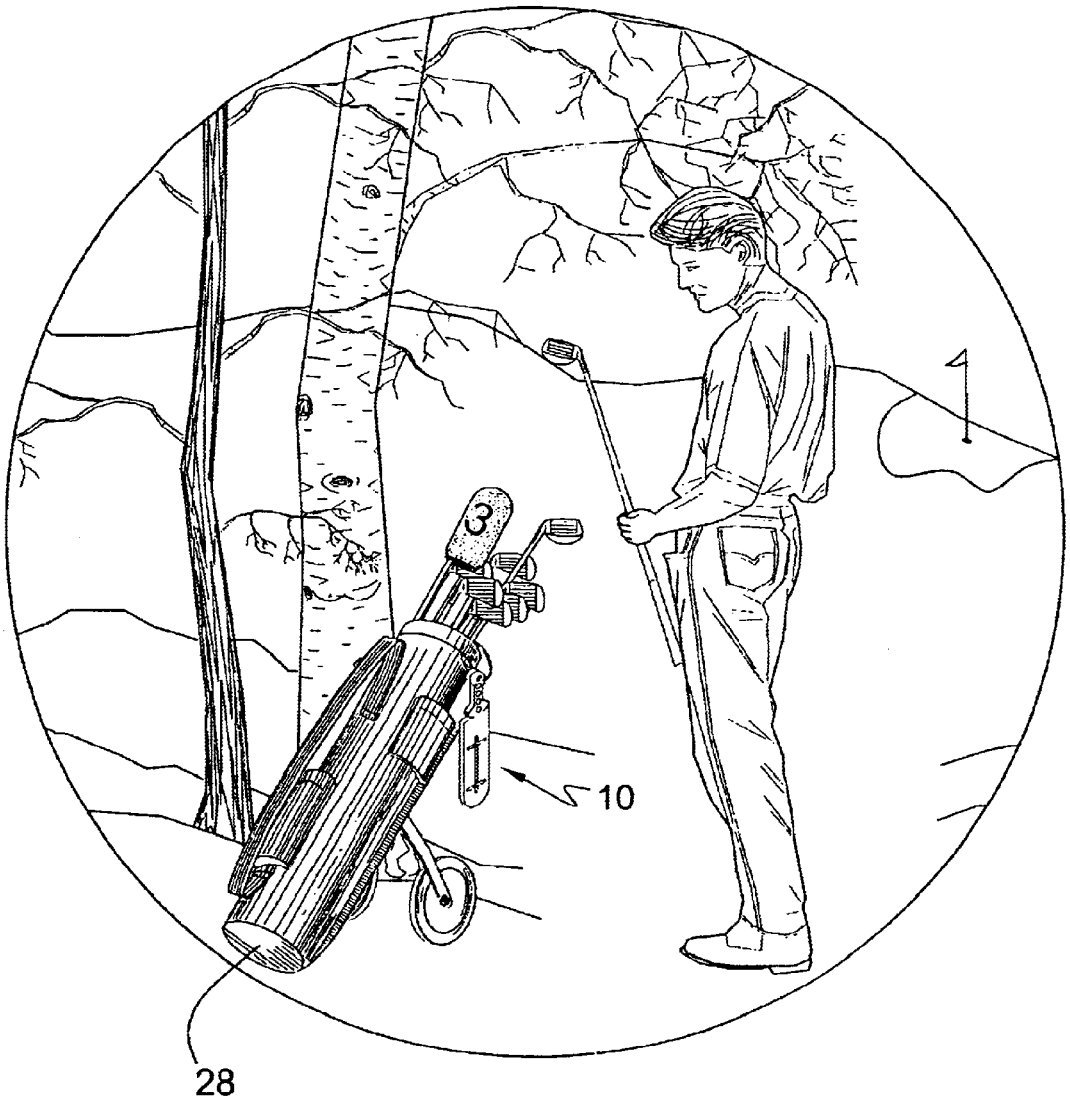
FIG. 4 is an illustrative view of the present invention while not in use.

Turning to FIG. 4, shown therein is an illustrative view of the present invention 10 while not in use. FIG. 4 exhibits an alignment paddle 10 being fastened to the golf bag 28 while not in use. The lightweight and proficient size of the alignment paddle 10 allows the alignment paddle to be stored in the golf bag 28 or attached to the golf bag as shown.

Figure 5:
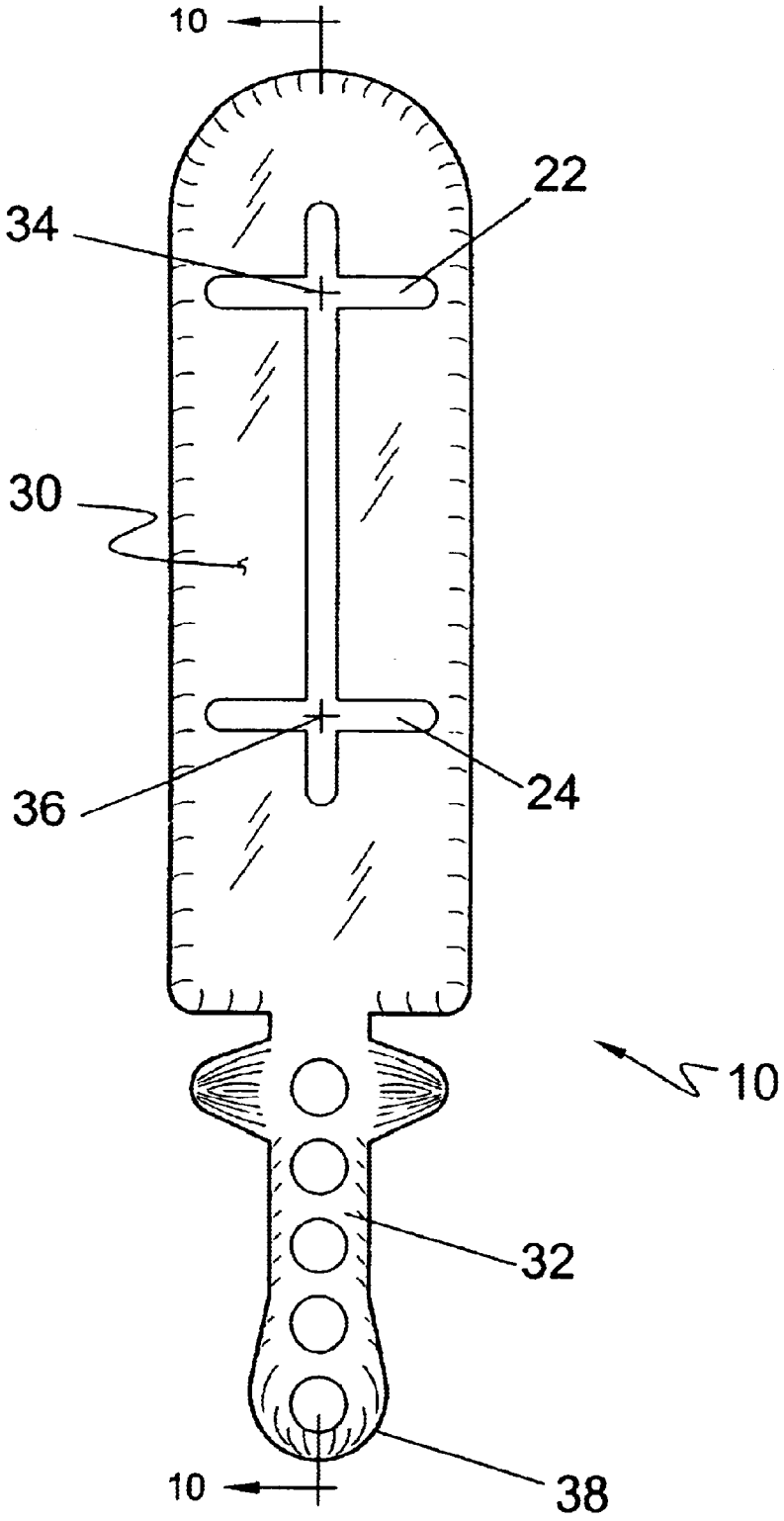
FIG. 5 is a front view of the present invention.

Turning to FIG. 5, shown therein is a front view of the present invention 10. The alignment paddle consists of a paddle base 30, a vertical aperture 26, two parallel horizontal apertures 22, 24, and a handle 32. The handle 32 having a flared end 38 is held by hand and positioned in front of the golfer's line of sight. The vertical aperture 26 is positioned such that the golf ball is visible through the lower centerline 36 and the intended target is visible through the upper centerline 34. Once this alignment is achieved, a straight line from the ball to the intended target is defined.

Figure 6:
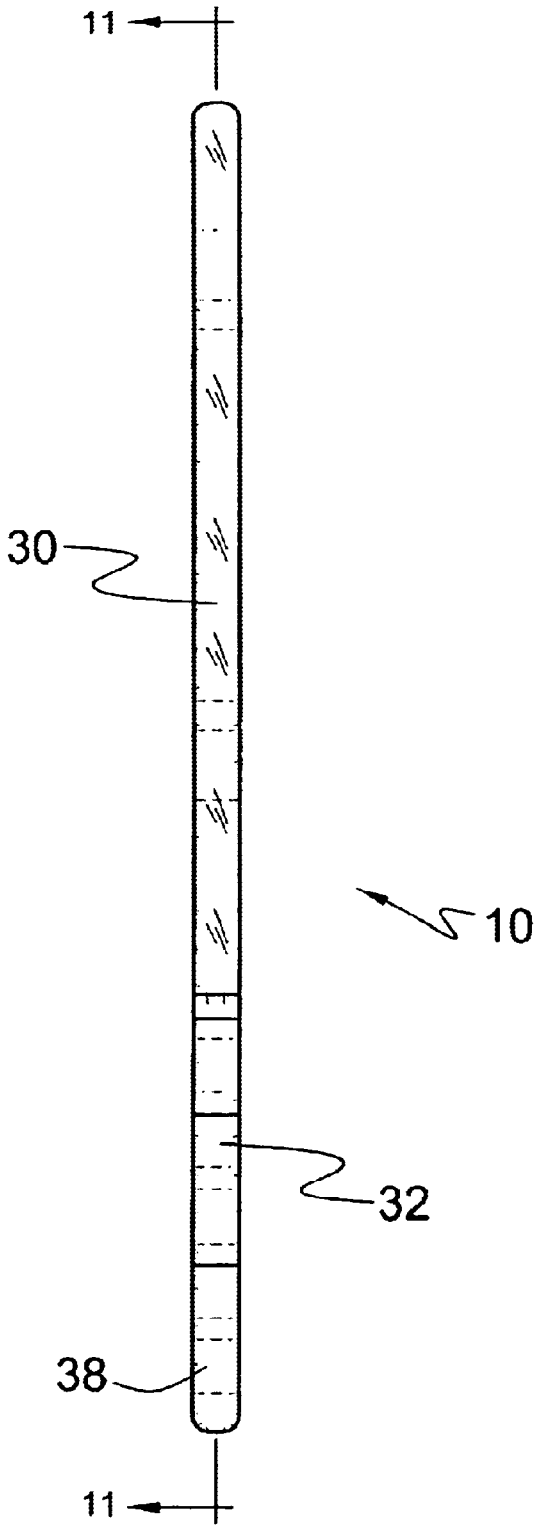
FIG. 6 is a side profile view of the present invention.

Turning to FIG. 6, shown therein is a side profile view of the present invention 10. The paddle base 30 has flat surfaces on both sides. The handle 32 is flat with a flare 38 at the end to allow for a comfortable grip of the alignment paddle.

Figure 7:
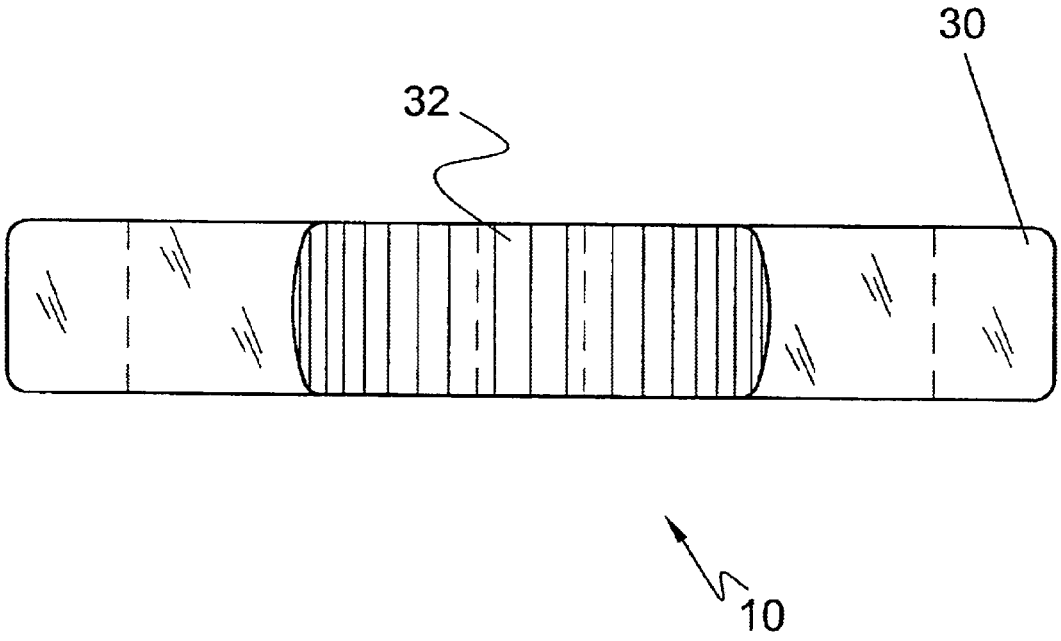
FIG. 7 is an end profile view of the present invention.

Turning to FIG. 7, shown therein is an end profile view of the present invention 10. FIG. 7 exhibits the alignment paddle shown with the handle 32 side end profile view. Each of the surfaces is rounded in order to limit sharp edges and potential hazard. Also shown is the paddle base 32.

Figure 8:
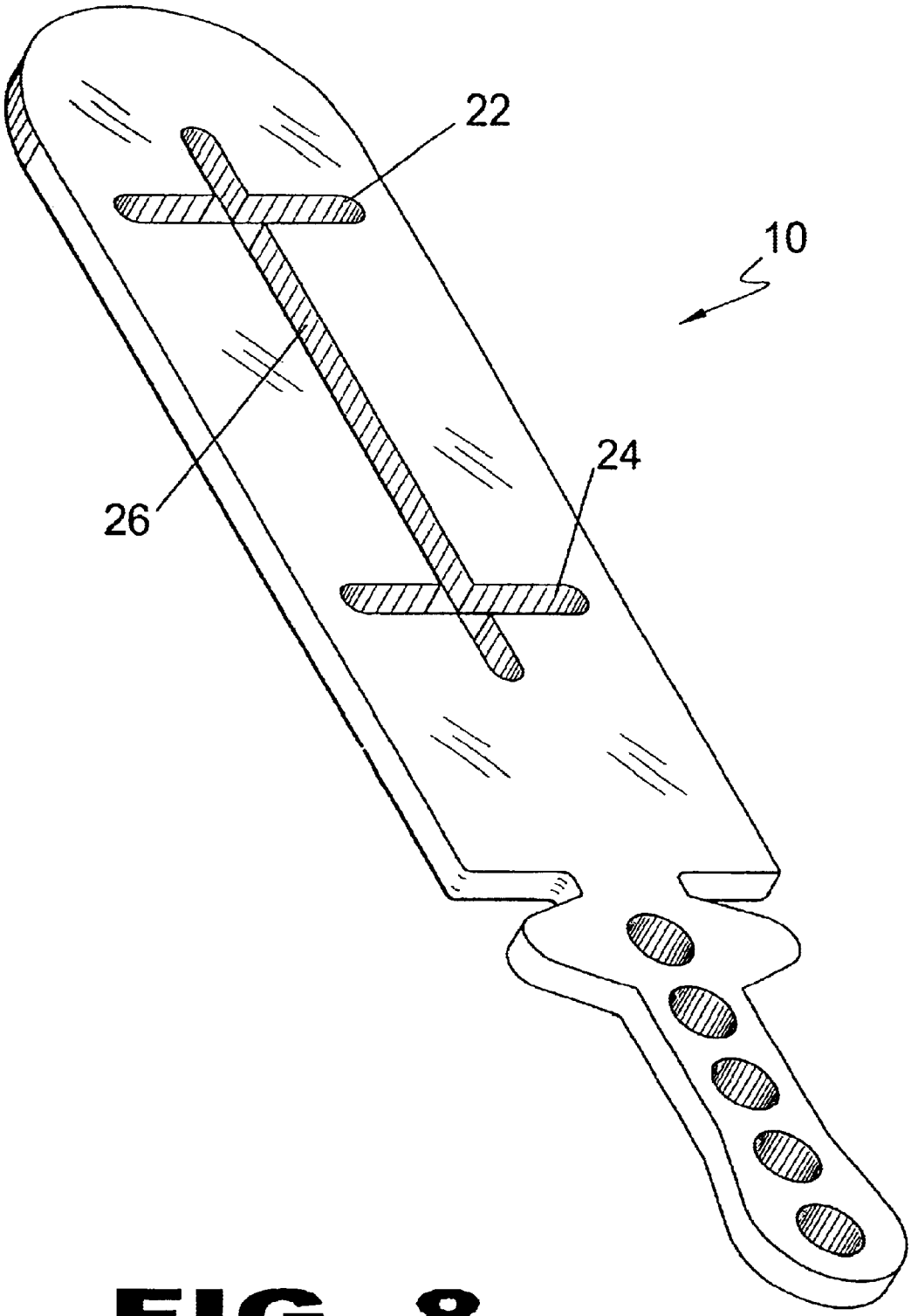
FIG. 8 is a prospective view of the present invention.

Turning to FIG. 8, shown therein is a prospective view of the present invention 10. The alignment paddle 10 includes two parallel horizontal apertures 22, 24 that intersect with the vertical aperture 26 creating upper and lower center lines. The horizontal apertures 22, 24 also provide for straight alignment in the event of a slope in the elevation of the green that would result in a break in the putt. In such case, the hole in the green would be visible at either side of the upper horizontal aperture 22, thus allowing for straight alignment to either side of the hole and visibility of the hole through the horizontal aperture.

Figure 9:
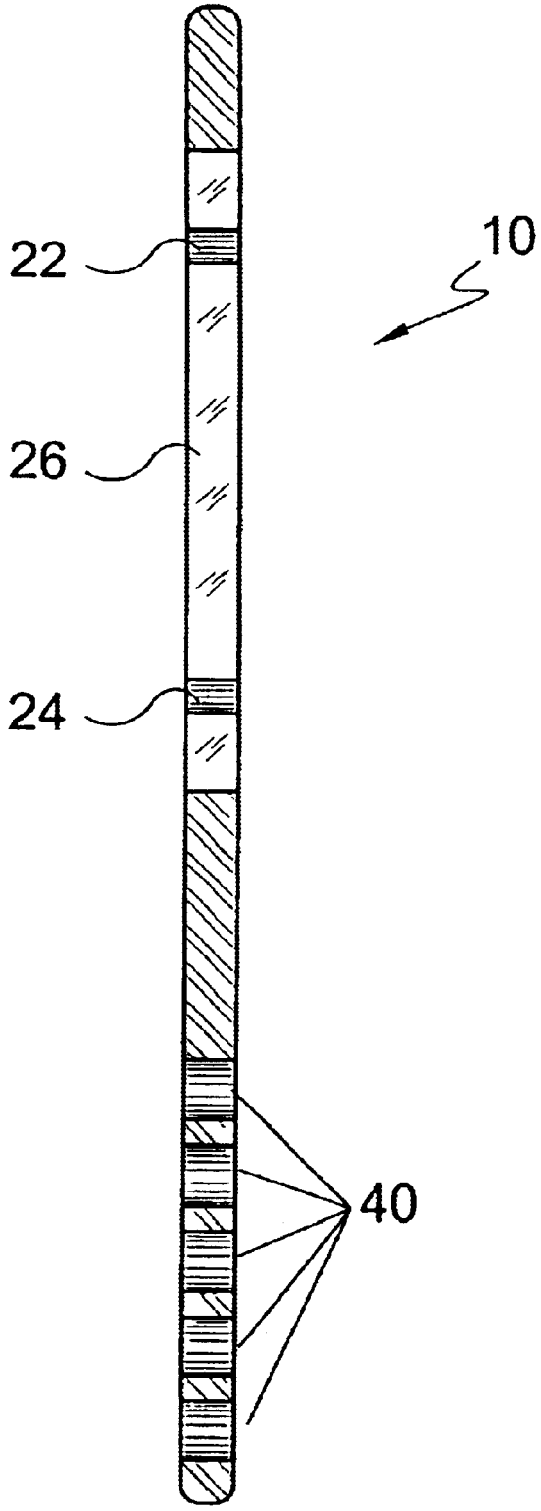
FIG. 9 is a cross sectional view of the present invention in reference to front view in FIG. 5.

Turning to FIG. 9, shown therein is a cross sectional view of the present invention 10 in reference to front view illustrated in FIG. 5. The alignment paddle 10 includes a series of through holes 40 in the handle enabling the alignment paddle to be fastened to the side of a golf bag while the alignment paddle is not in use. In addition, the through holes 40 reduce the weight, of the alignment paddle without reducing the rigidity of the handle. Other elements previously disclosed are also shown.

Figure 10:
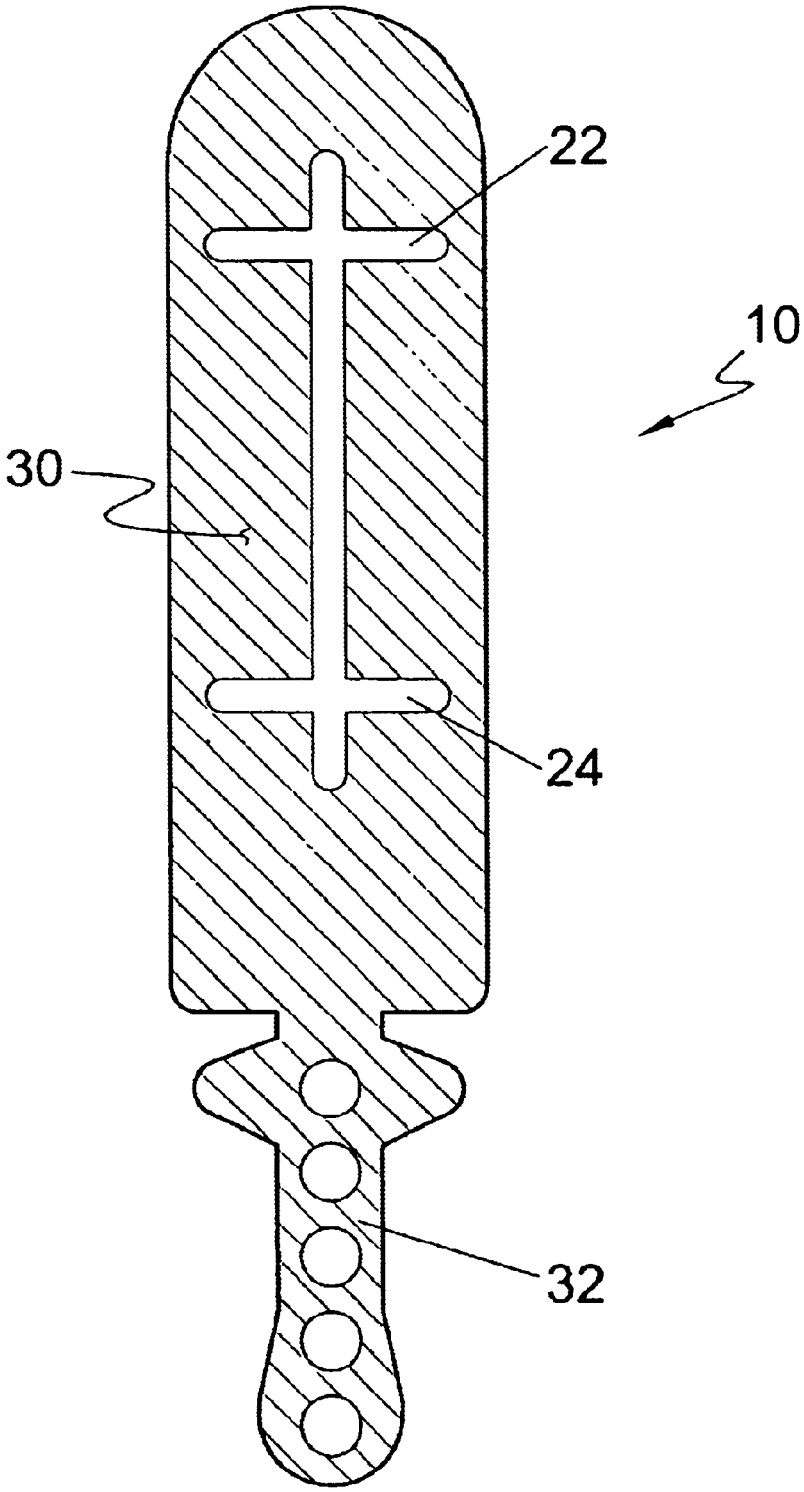
FIG. 10 is a cross sectional view of the present invention in reference to side profile view in FIG. 6.

Turning to FIG. 10, shown therein is a cross section of the side profile view illustrated in FIG. 6. The alignment paddle 10 is composed of one continuous molded object that can be manufactured with various materials to achieve ideal weight and style. In addition, the size and form of the alignment paddle 10 can be altered with curtailing the objectives of the present invention. Other elements previously disclosed are also shown.

I claim:

1. An apparatus to allow a user to align a golf ball with an intended target comprising:

a) an elongated base, said base being flat having an upper and a lower end, said base having a vertical aperture therein, an upper aperture therein, and a lower aperture therein;

b) wherein said upper and lower apertures intersect with said vertical aperture thereby forming an upper centerline and a lower centerline to permit the user to view the intended target in the upper centerline and the ball in the lower centerline thereby aligning the ball and the intended target; and, c) a handle disposed on said lower end of said handle to permit a user to grasp thereto.

2. The apparatus of claim 1, wherein said handle is flared so that a user can easily grasp the handle.

3. The apparatus of claim 2, wherein said handle has a plurality of holes therein to reduce the weight of the apparatus and provide a plurality of holes with which to attach the handle to a golf bag.

4. The apparatus of claim 3, wherein the edges of the apparatus are rounded so as to prevent injury to a user.

5. A method to allow a user to align a golf ball with an intended target comprising the steps of:

a) providing an elongated base, the base being flat having an upper and a lower end, the base having a vertical aperture therein, an upper aperture therein, and a lower aperture therein;

b) placing the upper and lower apertures in a position so that they intersect with the vertical aperture thereby forming an upper centerline and a lower centerline to permit the user to view the intended target in the upper centerline and the ball in the lower centerline;

c) forming a handle on the lower end of the base to permit a user to grasp thereto; and, d) viewing the intended target through the upper centerline and the ball through the lower centerline thereby aligning the ball and the intended target.

6. The method of claim 5, further comprising the step of viewing the upper portion of a downwardly sloping green surface through the upper centerline thereby making visible the hole in the green to the left of the centerline of a left-hand breaking green.

7. The method of claim 6, further comprising the step of viewing the upper portion of a downwardly sloping green surface through the upper centerline thereby making visible the hole in the green to the right of the centerline of a right-hand breaking green.

* * * * *